US011834294B2

(12) United States Patent
Nakai et al.

(10) Patent No.: US 11,834,294 B2
(45) Date of Patent: Dec. 5, 2023

(54) WOUND BODY AND METHOD FOR MANUFACTURING WOUND BODY

(71) Applicant: Mitsubishi Gas Chemical Company, Inc., Tokyo (JP)

(72) Inventors: Asami Nakai, Gifu (JP); Masataka Kaji, Kahoku (JP); Mitsuro Takagi, Kahoku (JP); Toshihiro Motochika, Kahoku (JP); Nobuhiko Matsumoto, Hiratsuka (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 332 days.

(21) Appl. No.: 17/272,889

(22) PCT Filed: Aug. 30, 2019

(86) PCT No.: PCT/JP2019/034047
§ 371 (c)(1),
(2) Date: Mar. 2, 2021

(87) PCT Pub. No.: WO2020/050156
PCT Pub. Date: Mar. 12, 2020

(65) Prior Publication Data

US 2021/0316956 A1 Oct. 14, 2021

(30) Foreign Application Priority Data

Sep. 3, 2018 (JP) ..... 2018-164476

(51) Int. Cl.
*B65H 55/04* (2006.01)

(52) U.S. Cl.
CPC ..... *B65H 55/04* (2013.01); *B65H 2701/313* (2013.01); *B65H 2701/37* (2013.01)

(58) Field of Classification Search
CPC ..... B65H 55/04; B65H 2701/313; B65H 2701/37
See application file for complete search history.

(56) References Cited

U.S. PATENT DOCUMENTS

2011/0248112 A1 10/2011 Corbett et al.
2016/0032082 A1 2/2016 Matsumoto et al.
(Continued)

FOREIGN PATENT DOCUMENTS

CN 105026627 A 11/2015
CN 106687627 A 5/2017
(Continued)

OTHER PUBLICATIONS

Machine Translation of JP 2005-179829 A, Jul. 7, 2005. (Year: 2005).*
(Continued)

*Primary Examiner* — William E Dondero
(74) *Attorney, Agent, or Firm* — Fitch, Even, Tabin & Flannery LLP

(57) ABSTRACT

Provided is a wound body of a commingled yarn, the wound body being capable of effectively suppressing fraying and sagging, disorder of a lower layer, or breakage of the commingled yarn during winding or use. Also provided is a method for manufacturing the wound body. The wound body contains a core member and a commingled yarn traversely wound onto the core member; wherein the commingled yarn is traversely wound onto the core member in two or more directions; and when the wound body is placed on a white substrate in a light-shielded space such that a cylindrical direction of the core member is upright, and light is irradiated toward a plane that includes a center axis of the cylinder, from a point that is moved a distance of a radius of the core member plus 180 cm in a direction perpendicular to the center axis from an intersection point between the center axis of the core member and the white substrate on a surface of the white substrate, and is further moved 210 cm in a direction perpendicular to the substrate face of the white substrate, linear reflection lines of a quantity equivalent to the number of directions of the traverse winding are formed on a surface of the traversely wound commingled yarn.

8 Claims, 7 Drawing Sheets

(56) References Cited

U.S. PATENT DOCUMENTS

| | | | |
|---|---|---|---|
| 2017/0260657 | A1 | 9/2017 | Nakai et al. |
| 2018/0126674 | A1 | 5/2018 | Ohtani et al. |

FOREIGN PATENT DOCUMENTS

| | | | |
|---|---|---|---|
| CN | 107405796 | A | 11/2017 |
| EP | 3192904 | A1 | 7/2017 |
| JP | S49-143543 | | 12/1974 |
| JP | S62-171871 | A | 7/1987 |
| JP | 2005-179829 | A | 7/2005 |
| WO | 2016/159340 | A1 | 10/2016 |

OTHER PUBLICATIONS

Extended European Search Report issued in corresponding European Application No. 19857411.3 dated Sep. 14, 2021 (7 pages).
International Preliminary Report on Patentability and Written Opinion for PCT/JP2019/034047, dated Nov. 12, 2019, and English Translation submitted herewith (20 pages).
International Search Report for PCT/JP2019/034047, dated Nov. 12, 2019, and English Translation submitted herewith (5 pages).
Office Action issued in corresponding Chinese Application No. 201980057400.7 dated Jun. 23, 2022 (13 pages).

* cited by examiner (a)

(b)

WOUND BODY AND METHOD FOR MANUFACTURING WOUND BODY

CROSS-REFERENCE TO RELATED APPLICATIONS

This application is a U.S. national phase application filed under 35U.S.C. § 371 of International Application Number PCT/JP2019/034047, filed Aug. 30, 2019, designating the United States, which claims priority from Japanese Application Number 2018-164476, filed Sep. 3, 2018.

FIELD OF THE INVENTION

The present invention relates to a wound body and a method for manufacturing a wound body.

BACKGROUND OF THE INVENTION

Reinforcing fibers are often blended into thermoplastic resins in order to improve the mechanical strength thereof. As an example of such, commingled yarns having continuous reinforcing fibers dispersed in thermoplastic resin fibers have been proposed (Patent Document 1, etc.). Such commingled yarns exhibit high strength while also having an appropriate level of suppleness.

CITATION LIST

Patent Documents

Patent Document 1: Pamphlet of WO 2016/159340

SUMMARY OF INVENTION

Commingled yarns obtained by combining thermoplastic resin fibers and continuous reinforcing fibers as described above may require attention during winding in the manufacturing process. Specifically, unlike so-called prepregs, in commingled yarns, the impregnation rate of a thermoplastic resin in continuous reinforcing fibers is extremely low, and therefore fraying and sagging when winding or during use, or disorder of the wound commingled yarn at a further inward side (hereinafter, also referred to as a "lower layer") is likely to occur. In addition, breakage may occur during winding or use of the commingled yarn.

Thus, an object of the present invention is to solve the problems described above by providing a wound body of a commingled yarn, the wound body being capable of suppressing or preventing fraying and sagging of the commingled yarn, disorder of a lower layer, or breakage, and to also provide a method for manufacturing the wound body.

Solution to Problem

As a result of an examination conducted by the present inventors on the basis of the above-mentioned problems, the above-mentioned problems can be solved by the following means <1>, and preferably by the following means <2> to <15>.

<1> A wound body including a core member and a commingled yarn traversely wound onto the core member; wherein the commingled yarn is traversely wound onto the core member in two or more directions; and when the wound body is placed on a white substrate in a light-shielded space such that a cylindrical direction of the core member is upright, and light is irradiated toward a plane that includes a center axis of the cylinder, from a point that is moved a distance of a radius of the core member plus 180 cm in a direction perpendicular to the center axis from an intersection point between the center axis of the core member and the white substrate on a surface of the white substrate, and is further moved 210 cm in a direction perpendicular to the substrate face of the white substrate, linear reflection lines of a quantity equivalent to the number of directions of the traverse winding are formed on a surface of the traversely wound commingled yarn.

<2> The wound body according to <1>, wherein the commingled yarn is constituted from continuous reinforcing fibers and continuous thermoplastic resin fibers.

<3> The wound body according to <1> or <2>, wherein the commingled yarn is traversely wound such that a gap is present between the commingled yarn and a closest commingled yarn traversely wound in the same direction; the commingled yarn is constituted from continuous reinforcing fibers and continuous thermoplastic resin fibers; a dispersion degree of the continuous reinforcing fibers in the continuous thermoplastic resin fibers is 90% or more; and an impregnation rate of the continuous thermoplastic resin fibers in the continuous reinforcing fibers is 5% or less;

where the dispersion degree is defined as a value that is obtained by embedding the commingled yarn in an epoxy resin, grinding a cross section perpendicular to a longitudinal direction of the embedded commingled yarn, photographing a cross-sectional view using an ultra-deep color 3D shape measuring microscope, drawing six equidistantly spaced auxiliary lines in a radial shape in the captured image, measuring lengths of continuous reinforcing fiber regions on each of the auxiliary lines as a1, a2, a3, . . . ai (i=n), measuring lengths of continuous thermoplastic resin fiber regions on each of the auxiliary lines as b1, b2, b3, . . . bi (i=m), and then calculating the dispersion degree from the following equation:

$$\left[1-\left(\frac{1}{n \text{ or } m}\times\frac{\sum_{i=1}^{n \text{ or } m}(a_i \text{ or } b_i)}{\sum_{i=1}^{n \text{ or } m}(a_i)+\sum_{i=1}^{n \text{ or } m}(b_i)}\right)\right]\times 100\ (\%); \quad \text{[Equation 1]}$$

and the impregnation rate is defined as a ratio at which the continuous thermoplastic resin fibers are impregnated into the continuous reinforcing fibers, and is a value expressed based on a ratio of a surface area of a cross section perpendicular to the longitudinal direction of the impregnated continuous thermoplastic resin fibers with respect to a surface area of a cross section perpendicular to the longitudinal direction of the commingled yarn.

<4> The wound body according to <2> or <3>, wherein the continuous thermoplastic resin fibers include at least one of polyamide resins, polyether ketone resins, and polyphenylene sulfide resins.

<5> The wound body according to <2> or <3>, wherein the continuous thermoplastic resin fibers include a polyamide resin constituted from a constituent unit derived from a diamine and a constituent unit derived from a dicarboxylic acid, with 50 mol % or more of the constituent units derived from a diamine being derived from xylylene diamine.

<6> The wound body according to any one of <2> to <5>, wherein the continuous reinforcing fibers include at least one of carbon fibers and glass fibers.

<7> The wound body according to any one of <1> to <6>, wherein the commingled yarn is traversely wound in two to four directions.

<8> The wound body according to any one of <1> to <7>, wherein the commingled yarn is traversely wound in at least a direction from 3 to 35° and a direction from −3 to −35°, with respect to a straight line orthogonal to the center axis of the core member.

<9> The wound body according to any one of <1> to <8>, wherein when the commingled yarn has been traversely wound one turn around the core member, the commingled yarn is moved 14 to 45 mm with regard to a central portion in the center axis direction of the core member.

<10> The wound body according to any one of <1> to <9>, wherein the commingled yarn is in a tape shape with a width from 7 to 20 mm.

<11> The wound body according to <10>, wherein a ratio of a moved distance/width of commingled yarn, which is a ratio of a distance at which the commingled yarn is moved with regard to the central portion in the center axis direction of the core member when the commingled yarn has been traversely wound one turn around the core member, to a width of the commingled yarn, is from 2.0 to 12.0.

<12> The wound body according to any one of <1> to <11>, wherein a diameter of the core member is from 5 to 20 cm.

<13> A wound body including a core member and a commingled yarn traversely wound onto the core member; wherein the commingled yarn is traversely wound such that a gap is present between the commingled yarn and a closest commingled yarn traversely wound in the same direction; the commingled yarn is constituted from continuous reinforcing fibers and continuous thermoplastic resin fibers; a dispersion degree of the continuous reinforcing fibers in the continuous thermoplastic resin fibers is 90% or more; an impregnation rate of the continuous thermoplastic resin fibers in the continuous reinforcing fibers is 5% or less; the commingled yarn is traversely wound in two to four directions; the commingled yarn is traversely wound in at least a direction from 3 to 25° and a direction from −3 to −25°, with respect to a straight line orthogonal to a center axis of the core member; a ratio of a moved distance/width of commingled yarn, which is a ratio of a distance at which the commingled yarn is moved with regard to a central portion in the center axis direction of the core member when the commingled yarn has been traversely wound one turn around the core member, to a width of the commingled yarn, is from 2.0 to 12.0; the commingled yarn is in a tape shape with a width from 7 to 20 mm; a ratio of a width of traverse winding/width of commingled yarn, which is a ratio of a width at which the commingled yarn is wound onto the core member to a width of the commingled yarn, is from 15 to 40; and a diameter of the core member is from 5 to 20 cm;

where the dispersion degree is defined as a value that is obtained by embedding the commingled yarn in an epoxy resin, grinding a cross section perpendicular to a longitudinal direction of the embedded commingled yarn, photographing a cross-sectional view using an ultra-deep color 3D shape measuring microscope, drawing six equidistantly spaced auxiliary lines in a radial shape in the captured image, measuring lengths of continuous reinforcing fiber regions on each of the auxiliary lines as a1, a2, a3, . . . ai (i=n), measuring lengths of continuous thermoplastic resin fiber regions on each of the auxiliary lines as b1, b2, b3, . . . bi (i=m), and then calculating the dispersion degree from the following equation:

$$\left[1-\left(\frac{1}{n \text{ or } m}\times\frac{\sum_{i=1}^{n \text{ or } m}(a_i \text{ or } b_i)}{\sum_{i=1}^{n \text{ or } m}(a_i)+\sum_{i=1}^{n \text{ or } m}(b_i)}\right)\right]\times 100\ (\%); \quad \text{[Equation 2]}$$

and the impregnation rate is defined as a ratio at which the continuous thermoplastic resin fibers are impregnated into the continuous reinforcing fibers, and is a value expressed based on a ratio of a surface area of a cross section perpendicular to the longitudinal direction of the impregnated continuous thermoplastic resin fibers with respect to a surface area of a cross section perpendicular to the longitudinal direction of the commingled yarn.

<14> The wound body according to any one of <1> to <13>, wherein the commingled yarn is non-twisted.

<15> A method for manufacturing a commingled yarn described in any one of <1> to <14>, the method including traversely winding the commingled yarn onto the core member in at least two directions from 3 to 25° and from −3 to −25°, with respect to a straight line orthogonal to the core member, and traversely winding such that a gap is present between the commingled yarn and a closest commingled yarn traversely wound in the same direction.

According to the present invention, a wound body of a commingled yarn in which fraying and sagging, disorder of a lower layer, or breakage of the commingled yarn can be effectively suppressed, and a method for manufacturing the wound body can be provided.

DESCRIPTION OF EMBODIMENTS

The contents of the present invention will be described in detail below. Note that in the present specification, the phrase "from . . . to . . . " is used in a sense that includes the numerical values in the phrase as the lower and upper limit values.

A wound body of the present invention includes a core member and a commingled yarn traversely wound onto the core member, and is characterized in that the commingled yarn is traversely wound onto the core member in two or more directions; and when the wound body is placed on a white substrate in a light-shielded space such that a cylindrical direction of the core member is upright, and light is irradiated toward a plane that includes a center axis of the cylinder, from a point that is moved a distance of a radius of the core member plus 180 cm in a direction perpendicular to the center axis from an intersection point between the center axis of the core member and the white substrate on a surface of the white substrate, and is further moved 210 cm in a direction perpendicular to the substrate face of the white substrate, linear reflection lines of a quantity equivalent to the number of directions of the traverse winding are formed on a surface of the traversely wound commingled yarn. Fraying and sagging, disorder of the lower layer, and breakage can be effectively suppressed by adopting such a configuration. In particular, fraying and sagging, disorder of the lower layer, and breakage when winding or using (or when unwinding or molding) the commingled yarn can be effectively suppressed. Continuous reinforcing fibers are prone to breakage due to factors such as being caught on the continuous thermoplastic resin fibers or an adjacent commingled yarn, but in the present invention, such breakage can be effectively suppressed.

<Reflection Line>

Figure 1:
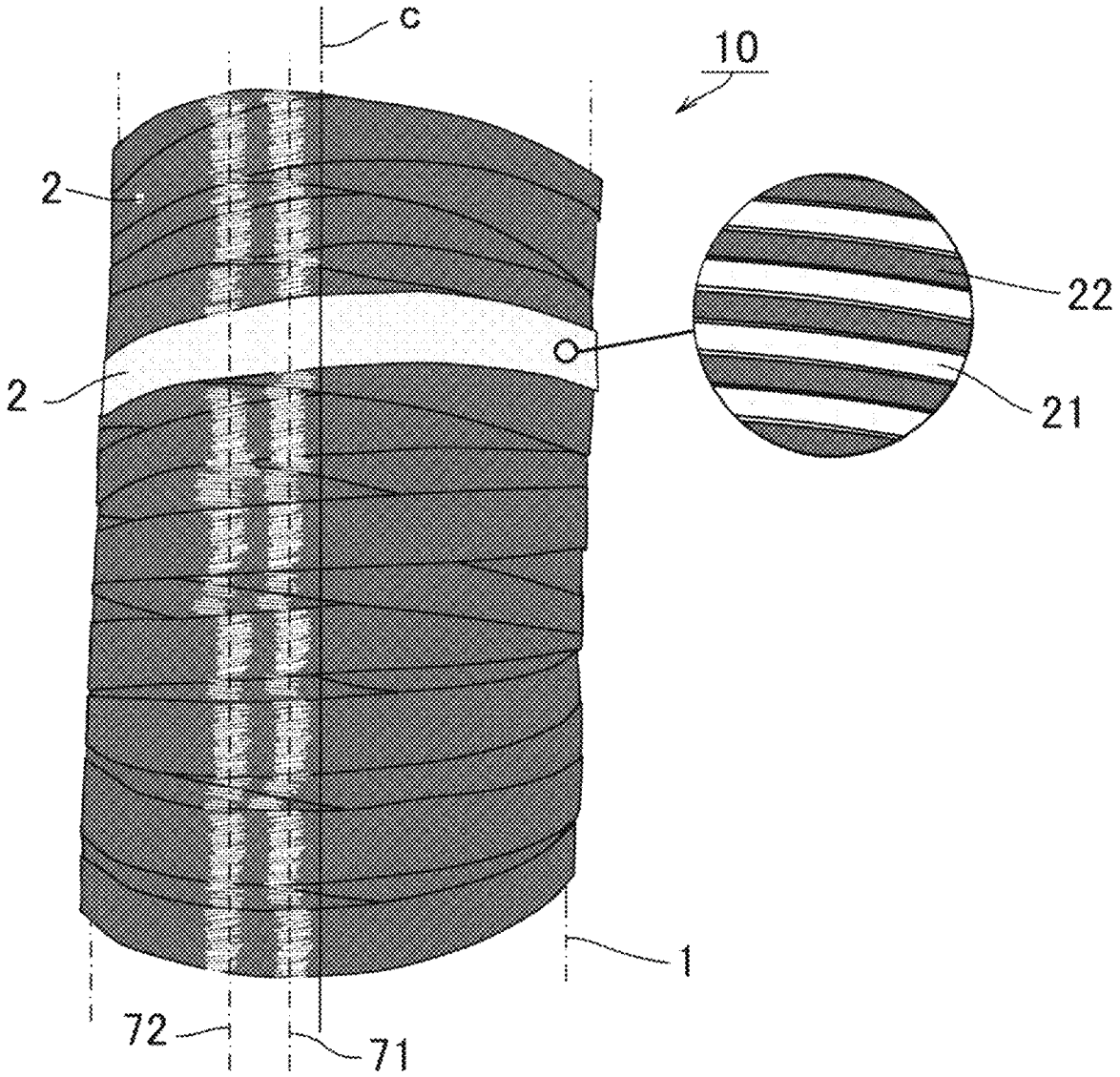
FIG. 1 is a perspective view schematically illustrating a wound body according to an embodiment of the present invention.
Figure 3:
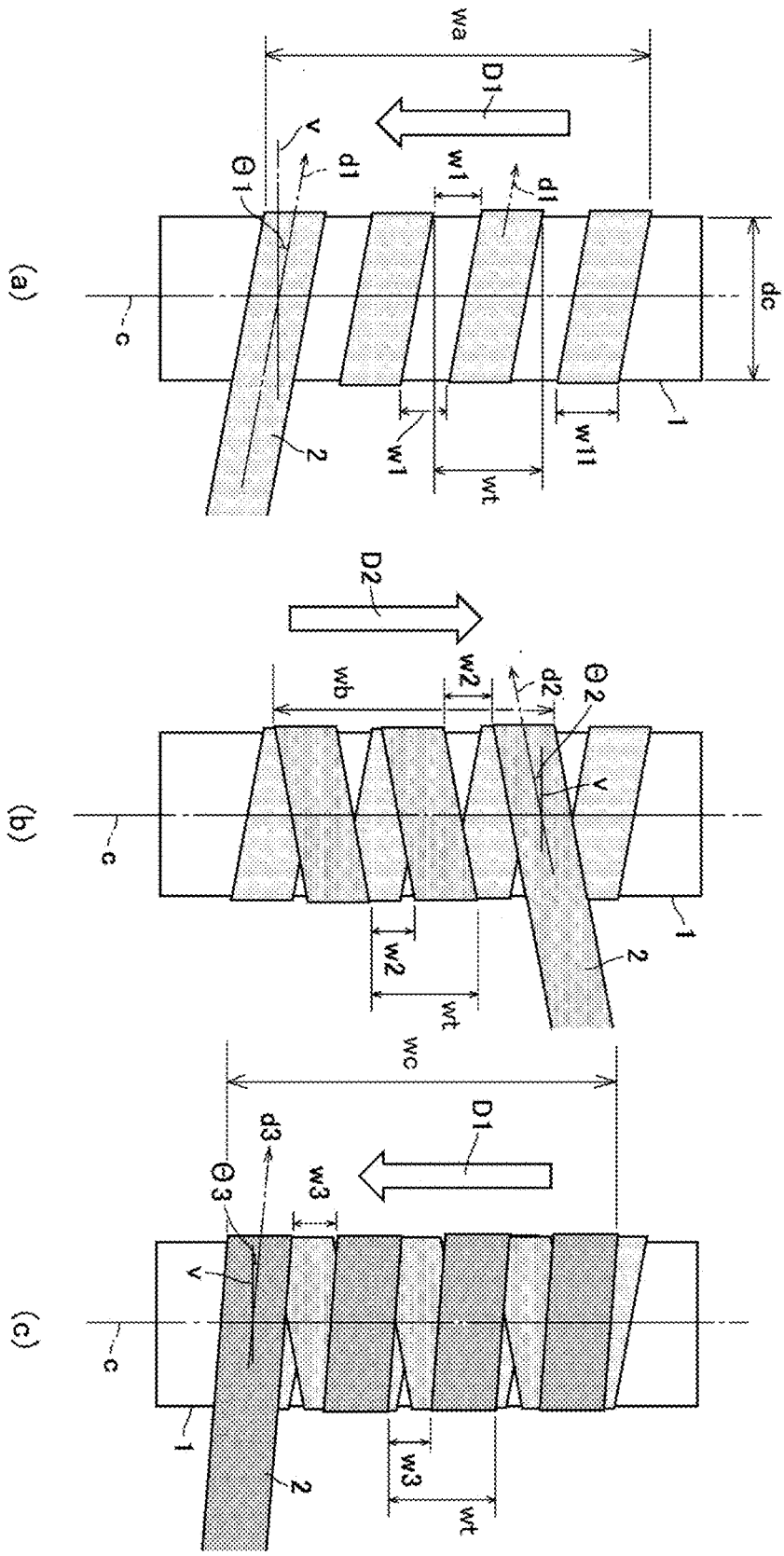
FIG. 3 is a process explanatory diagram schematically illustrating, from a side view, a step of winding a commingled yarn around a core member in the wound body of the present invention.

FIG. 1 is a perspective view schematically illustrating a wound body according to an embodiment of the present invention. A wound body 10 illustrated in FIG. 1 has a core member 1 and a commingled yarn 2 traversely wound onto the core member 1. Here, "traverse winding" refers to winding a commingled yarn in a direction diagonal to a line perpendicular to a center axis c of the core member. In the wound body of FIG. 1, the commingled yarn 2 is traversely wound in two directions. The direction of the traverse winding means the angle when winding diagonally with respect to a line perpendicular to the center axis c of the core member. In other words, traversely winding the commingled yarn 2 in two or more directions means that two or more winding angles are set, and the commingled yarn 2 is traversely wound at the set winding angles. For example, as illustrated in FIG. 3, which will be described in detail below, a first winding (first layer) is wound in a d1 direction, and a second winding (second layer) is wound in a d2 direction. Note that in FIG. 1, a portion of the traversely wound commingled yarn is illustrated with different colors for the convenience of understanding.

The number of directions of the traverse windings, that is, the number of reflection lines, is preferably from 2 to 6, more preferably from 2 to 4, and even more preferably 3 or 4. When the number of directions is set to 3 or more, entanglement of the commingled yarn with another commingled yarn in an adjacent lower layer or upper layer does not easily occur, and the commingled yarn can be more appropriately wound. Furthermore, when the number of directions of the traverse windings is set to an odd number, a wound body that is more aesthetically pleasing can be obtained.

In the wound body of the present invention, the reflection lines are adjusted so as to be the same number as the number of traverse winding directions. The reflection lines appear, for example, when light is irradiated from a predetermined position described in the <Irradiation Conditions> section below. Reflection lines 71, 72 are lines that are reflected by light irradiation, and are formed in a generally straight manner in the center axis c direction of the core on the surface of the commingled yarn wound on the wound body. In addition, when the commingled yarn is traversely wound in three directions, three reflection lines are adjusted to appear on the surface of the traversely wound commingled yarn. In addition, adjustments are made such that four reflection lines appear when the commingled yarn is traversely wound in four directions, and five reflection lines appear when the commingled yarn is traversely wound in five directions. Adjusting the number of the reflection lines can be achieved, for example, by traversely winding a commingled yarn having a high degree of dispersion and a low impregnation rate such that a gap is present between the commingled yarn and a closest commingled yarn traversely wound in the same direction. Furthermore, adjusting the number of reflection lines can also be achieved by appropriately adjusting the angle of the traverse winding, the diameter of the core member, the winding width of the commingled yarn, the (winding width)/(commingled yarn width), the length of the commingled yarn to be wound, and the like.

The reflection lines 71, 72 of the present embodiment appear in the center axis c direction of the core member (typically the longitudinal direction of the wound body). The width of the reflection lines 71, 72 is not particularly limited, and is preferably 40% or less, more preferably 30% or less, and even more preferably 20% or less relative to the diameter of the core member (FIG. 3). The lower limit is preferably 1% or more, more preferably 2% or more, and even more preferably 3% or more. When the wound body is configured with reflection lines having such a width, fraying, sagging, lower layer disorder, and breakage can be more effectively suppressed.

Note that as the linear state in which the reflection lines appear, in addition to a straight line in a geometrical sense, the linear state also includes a case in which, as illustrated in FIG. 1, the reflection lines appear as somewhat broken lines or include curved portions mixed therein. In addition, the reflection lines may appear over the entire length of the core member of the wound body in the center axis c direction, but this is not necessarily the case at the end sections.

The color of the reflection lines is not particularly limited, but ordinarily, the reflection lines are visible in a color of the same group as the color of the light emitted from the light source, and the reflection lines typically appear to be a color ranging from white to yellowish white.

<Commingled Yarn>

Figure 2:
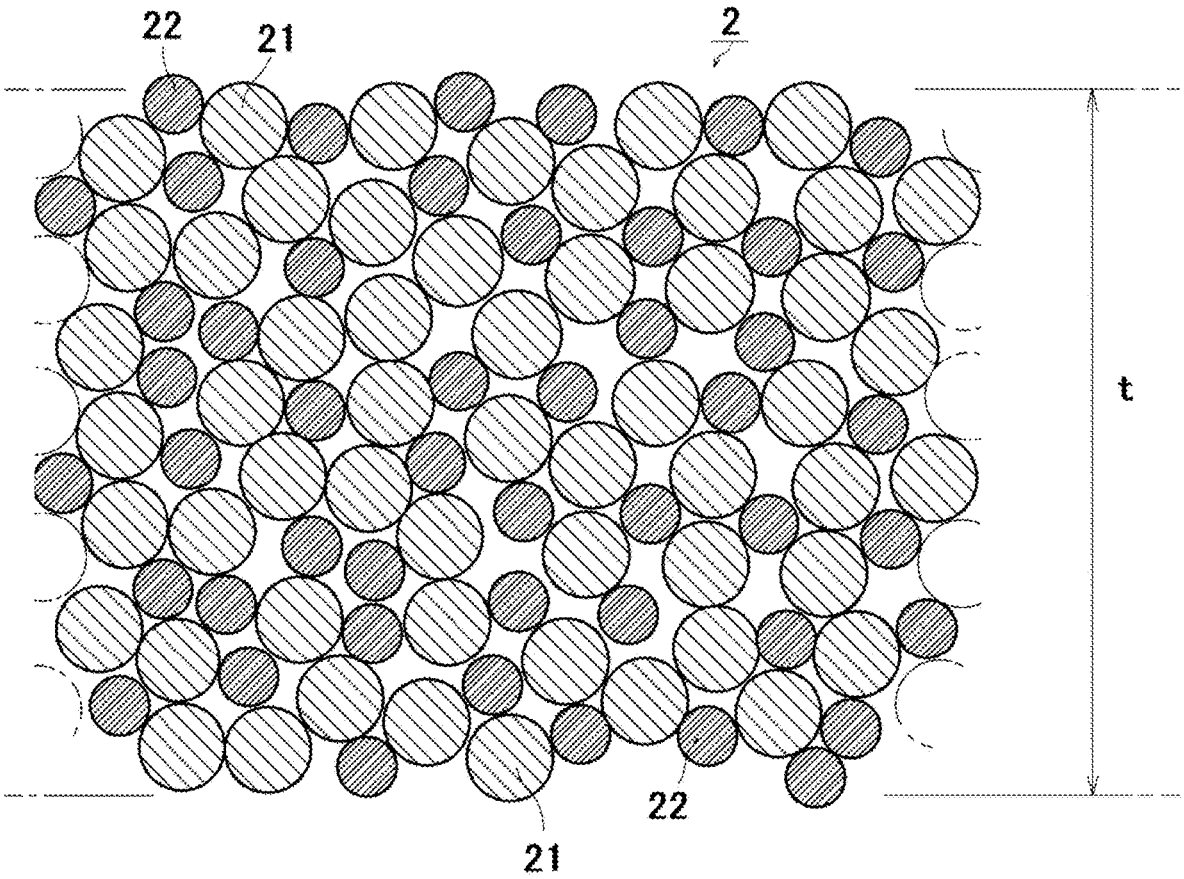
FIG. 2 is a cross-sectional view schematically illustrating a portion of a commingled yarn according to an embodiment of the present invention.

The commingled yarn 2 is preferably used in a wide tape shape. However, the commingled yarn may be in the form of a thread or a bundle. An enlarged schematic view of the state of the commingled yarn 2 is depicted in the circle of FIG. 1. Moreover, a schematic cross-sectional view of the commingled yarn 2 is illustrated in FIG. 2. As described above, the commingled yarn 2 of the present embodiment is constituted by continuous thermoplastic resin fibers 21 and continuous reinforcing fibers 22. The continuous thermoplastic resin fibers and the continuous reinforcing fibers may each be only one type, or may be two or more types. Here, constitution of the commingled yarn 2 from the continuous thermoplastic resin fibers and the continuous reinforcing fibers 22 means that other constituent elements may be included within a range that does not depart from the spirit of the present invention.

In the commingled yarn 2 of the present embodiment, as illustrated in FIG. 1, the continuous thermoplastic resin fibers 21 and the continuous reinforcing fibers 22 are preferably not twisted together, and are more preferably prepared in a tape shape in a state of being arranged in parallel. In the commingled yarn 2 of the present embodiment, unlike a prepreg, a majority of the continuous thermoplastic resin fibers 21 are present in the continuous reinforcing fibers 22 while maintaining the shape of the fibers, and the continuous thermoplastic resin fibers 21 and the continuous reinforcing fibers 22 are blended together and assembled in the form of a tape, a bundle, or threads. These fibers are assembled into a tape shape or the like by a surface treatment agent of the continuous thermoplastic resin fibers 21 and a surface treatment agent of the continuous reinforcing fibers 22.

In the present invention, a thickness t (FIG. 2) of the commingled yarn is preferably 10 μm or more, more preferably 30 μm or more, even more preferably 50 μm or more, and yet even more preferably 100 μm or more. The upper limit is preferably 1000 μm or less, more preferably 500 μm or less, even more preferably 250 μm or less, and yet even more preferably 210 μm or less.

In the present invention, a width w11 (FIG. 3) of the commingled yarn is preferably not less than 0.5 mm, more preferably not less than 1 mm, even more preferably not less than 3 mm, yet even more preferably not less than 5 mm, and still even more preferably not less than 7 mm. The upper limit is preferably 100 mm or less, more preferably 50 mm or less, and even more preferably 20 mm or less.

Furthermore, a length of the commingled yarn in the longitudinal direction (tape length), is not particularly limited, and is preferably 10 m or longer, and more preferably 80 m or longer. As the upper limit, 100000 m or less is practical, 10000 m or less is more practical, and 5000 m or less is even more practical. The commingled yarn can be sufficiently bound by setting the length of the commingled yarn to not less than 10 m.

A ratio of w11/t, which is the relationship between the thickness t and the width w11 of the commingled yarn, is preferably 1 or more, more preferably 10 or more, even more preferably 20 or more, and yet even more preferably 30 or more. The upper limit is preferably 1000 or less, more preferably 500 or less, even more preferably 100 or less, still more preferably 80 or less, and yet even more preferably 60 or less. With the relationship within the range as above, a material having better suppleness can be obtained.

<Traverse Winding>

FIG. 3 is a diagram schematically illustrating a form of traverse winding employed in the present embodiment. FIG. 3 is an aspect in which the commingled yarn 2 is traversely wound in three directions. FIG. 3(*a*) illustrates a state of a first winding on the core member 1. With the first winding, the commingled yarn 2 is wound onto the core member 1 in a D1 direction and a d1 direction.

The commingled yarn is usually traversely wound from one end section in the width of the traverse winding to the other end section, but winding does not necessarily need to begin from one end section, and may begin from near a center section.

In the present embodiment, the commingled yarn is wound in the direction (traverse winding direction) d1, which is inclined with respect to the center axis c direction of the core member 1.

In this manner, a known method can be used as the method for winding in the D1 direction and the d1 direction. For example, while the commingled yarn can be supplied from a certain direction, the winding angle thereof can be appropriately changed while the core member is rotated. In the present embodiment, when the commingled yarn 2 is being wound onto the core member 1, the commingled yarn 2 is preferably wound while maintaining a gap w1 between the commingled yarn 2 and a closest commingled yarn traversely wound in the same direction. By maintaining a gap in this manner while traversely winding the commingled yarn 2, fraying can be more effectively suppressed. Furthermore, by traversely winding with a gap, disorder of the commingled yarn of the lower side (the side closer to the core member) can be effectively suppressed when winding a second or subsequent winding.

Examples of the winding method include a method of fixing the core member, and traversely winding while shaking a guide, and a method of fixing the guide, and traversely winding while shaking the core member. When the commingled yarn has a tape-like (flat) shape, the method of traversely winding while shaking the core member is preferable. Shaking and traversely winding the core member makes it easier to maintain a tape-like (flat) shape. Furthermore, when being wound, the commingled yarn is preferably wound so that twisting does not occur in the yarn.

In the present invention, the gap w1 of the commingled yarn when traversely wound is preferably not less than 3 mm, more preferably not less than 5 mm, even more preferably not less than 7 mm, yet even more preferably not less than 10 mm, and still even more preferably not less than 13 mm. The upper limit is preferably 100 mm or less, more preferably 50 mm or less, even more preferably 40 mm or less, yet even more preferably 30 mm or less, still even more preferably 25 mm or less, and yet even more preferably 20 mm or less. Sagging and disordering of the commingled yarn can be more effectively suppressed by providing a gap in the range described above between traversely wound commingled yarns.

The ratio (w1/w11) of the width w11 to the gap w1 of the commingled yarn is preferably 0.1 or more, more preferably 0.2 or more, and even more preferably 0.3 or more. The upper limit is preferably 2 or less, more preferably 1.7 or less, and even more preferably 1.5 or less.

FIG. 3(*b*) illustrates the state of the second winding. As illustrated in FIG. 3(*b*), here, the commingled yarn 2 is moved and wound in a D2 direction and a d2 direction. The direction d2 is a direction differing from the direction d1 of the first winding. Specifically, an angle θ2 at which the commingled yarn is traversely wound with respect to a line v perpendicular to the center axis is at a side opposite an angle θ1 with respect to the perpendicular line v. In the present specification, the directions on both sides of the perpendicular line v are defined as the positive and negative angles of the angle θ at which the commingled yarn is traversely wound. For example, when the angle θ1 is +20°, the angle θ2 will be expressed as −15°.

A gap w2 of traverse winding of the second winding may be the same as or different from the gap w1 of the first winding (first layer). The preferred range of the gap w2 is the same as that of the gap w1.

FIG. 3(*c*) illustrates the state of a third winding. The winding direction at this time is the direction D1 and a direction d3. An angle θ3 of traverse winding is on the same side of the perpendicular line v as the direction d1 of the first winding and is a positive angle (for example, +7°).

A gap w3 of traverse winding of the third winding may be the same as or different from the first winding gap w1 and the second winding gap w2. The preferred range of the gap w3 is the same as that of the gap w1.

Thus, in the embodiment of FIG. 3, the commingled yarn 2 is traversely wound in three directions (d1, d2, d3). In other words, there are three angles (θ1, θ2, θ3) of traverse winding. If the commingled yarn 2 is repeatedly wound in these three directions, a wound body wound in three directions is formed.

The traverse winding angles θ (for example, θ1 to θ3 in FIG. 3) are preferably 3° or more, and more preferably 5° or more. The upper limit is preferably 35° or less, more preferably 25° or less, even more preferably 18° or less, and yet even more preferably 15° or less. The preferable angles θ are the same in the negative direction as well, and specifically, are preferably −3° or less, and more preferably −5° or less. The lower limit is preferably not less than −35°, more preferably not less than −25°, even more preferably not less than −18°, and yet even more preferably not less than −15°. By setting the traverse winding angle 9 to be not greater than ±35°, fraying can be more effectively suppressed when the commingled yarn is turned back at an end section of the core member.

It should be noted that in the technical field of the present invention, the traverse winding angle may include normal errors rather than being an angle in a geometric sense. For example, a difference of less than 1° is interpreted as being an error, and the traverse winding is considered to be in the same direction even with such an error.

When the commingled yarn is traversely wound one turn around the core member, a distance (for example, the distance "wt" in FIG. 3) at which the commingled yarn is moved with regard to a central portion in the center axis c direction of the core member is preferably not less than 14 mm, more preferably not less than 15 mm, and even more preferably not less than 16 mm. The upper limit is preferably 110 mm or less, more preferably 50 mm or less, even more preferably 45 mm or less, yet even more preferably 42 mm or less, and still even more preferably 40 mm or less. Note that when the commingled yarn is traversely wound one turn around the core member, the distance at which the commingled yarn is moved in the center axis c direction of the core member is constant except for at the end sections. On the other hand, the end sections serve as a point where the yarn is turned back, and thus are not limited to the distance thereof.

The value of the distance wt may be the same or different between the first winding (first layer) and the second and subsequent windings (second layer, etc.), but the distance wt is preferably the same.

A ratio of a (moved distance)/(width of the commingled yarn), which is a ratio of the distance at which the commingled yarn is moved with regard to the central portion in the center axis direction of the core member when the commingled yarn has been traversely wound one turn around the core member, to a width of the commingled yarn, is preferably from 2.0 to 12.0, and more preferably from 2.3 to 6.0. Fraying can be more effectively suppressed when the ratio thereof is set to such a range.

A width of movement of the commingled yarn 2 in the center axis c direction of the core member 1 when traversely winding the commingled yarn 2 onto the core member 1, or in other words, the winding width (wa, wb, we in FIG. 3), is not particularly limited, but is preferably 10 cm or more, more preferably 15 cm or more, and even more preferably 20 cm or more. The upper limit is preferably 40 cm or less, more preferably 35 cm or less, and even more preferably 30 cm or less. In the present embodiment, the winding width wa of the first winding, the winding width wb of the second winding, and the winding width wc of the third winding are each illustrated in FIG. 3. The winding widths wa, wb, and wc may each be different, but from the perspective of uniformity of the winding width, the difference in each winding width is preferably within 20% of the winding width, more preferably within 10% of the winding width, and even more preferably within 5% of the winding width.

A ratio (winding width/commingled yarn width) of the winding width wa to the width w11 of the commingled yarn is preferably 15 or more, more preferably 18 or more, and even more preferably 21 or more. The upper limit is preferably 40 or less, more preferably 35 or less, and even more preferably 32 or less. By setting the ratio of the (winding width)/(commingled yarn width) to 15 or more, the commingled yarn serving as a lower layer can be sufficiently pressed down, and disorder in the lower layer can be more effectively suppressed.

A ratio Vt/Vc of a volume (Vt) of the thermoplastic resin fibers to a volume (Vc) of the continuous reinforcing fibers in the commingled yarn is preferably at least 0.3, more preferably at least 0.5, and even more preferably at least 0.8. The upper limit is preferably 10 or less, more preferably 5 or less, and even more preferably 3 or less.

The ratio of the continuous thermoplastic resin fibers to the continuous reinforcing fibers in the commingled yarn is not particularly limited, but a ratio (Mc/Mt) of a mass (Mc) of the continuous reinforcing fibers to a mass (Mt) of the continuous thermoplastic resin fibers is preferably not less than 0.1, more preferably not less than 0.3, and even more preferably not less than 0.5. The upper limit is preferably 5 or less, more preferably 3 or less, and even more preferably 2 or less.

The mass ratio of the continuous reinforcing fibers in the commingled yarn is preferably from 50 to 80 mass %, and more preferably from 55 to 75 mass %. Adopting a commingled yarn allows for the blending of many continuous reinforcing fibers in this manner.

In the commingled yarn used in the present invention, preferably 95 mass % or more, more preferably 97 mass % or more, and even more preferably 99 mass % or more of the fibers constituting the commingled yarn are continuous reinforcing fibers and continuous thermoplastic resin fibers. In addition, 100 mass % of the fibers constituting the commingled yarn may be continuous reinforcing fibers and continuous thermoplastic resin fibers.

<Core Member>

In the present embodiment, a core member that is in the form of a right cylinder is adopted. The inside of the core member may be hollow or solid, and typically, a cylindrically shaped core member that is hollow is adopted. The material of the core member is not particularly limited, but the core member may be a resin molded article, or may be made of paper or metal. The surface of the core member may be embossed. Through embossing, shifting of the commingled yarn of the first winding can be more effectively suppressed when implementing traverse winding.

A diameter dc (FIG. 3(*a*)) of the core member is preferably 1 cm or more, more preferably 5 cm or more, and even more preferably 6 cm or more. The upper limit is preferably 50 cm or less, more preferably 20 cm or less, even more preferably 16 cm or less, and yet even more preferably 13 cm or less.

The width of the core member (the length of the core agent in a direction perpendicular to the diameter dc) is not particularly limited, and can be, for example, from 25 to 50 cm.

Additionally, the winding width (for example, wa, wb and wc in FIG. 3) with respect to the width of the core member as a ratio of (winding width)/(core member width) is preferably from 0.5 to 0.95, more preferably from 0.7 to 0.93, and even more preferably from 0.8 to 0.91.

<Irradiation Conditions>

In the present invention, the light irradiation conditions for obtaining the reflection lines described above can be set as follows.

The wound body is placed on a white substrate in a light-shielded space such that the cylindrical direction of the core member is upright.

Light is irradiated toward a plane that includes a center axis of the cylinder, from a point that is moved a distance of the radius of the core member plus 180 cm in a direction perpendicular to the center axis from an intersection point between the center axis of the core member and the white substrate on a surface of the white substrate, and is further moved 210 cm in a direction perpendicular to the substrate face of the white substrate.

Figure 4:
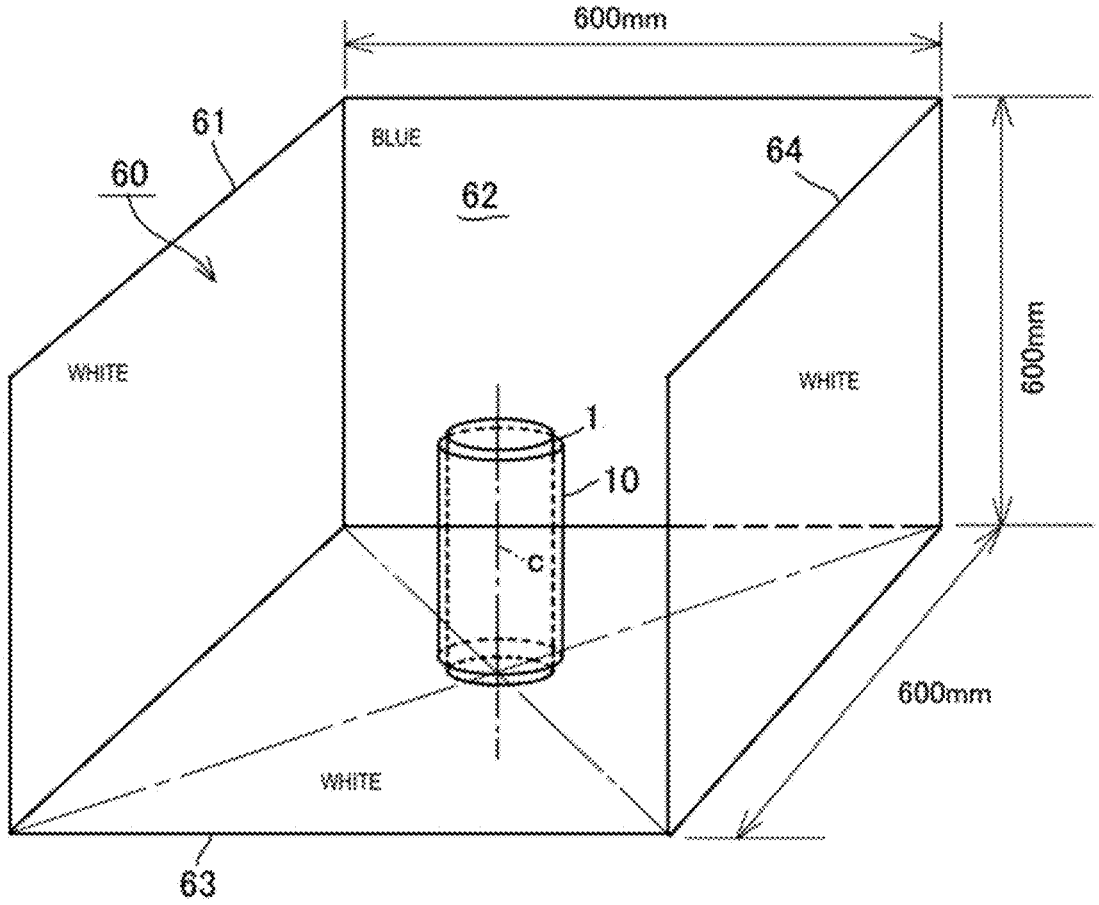
FIG. 4 is a perspective view schematically illustrating a preferred embodiment of a light-shielded space employed in light irradiation of a wound body.

FIG. 4 is a perspective view schematically illustrating a preferred embodiment of a light-shielded space employed in light irradiation. A light-shielded space 60 according to the present embodiment includes a bottom face 63 made of a white substrate, left and right side surfaces 61, 64 made from white substrates, and a back face formed from a blue substrate 62. In the present embodiment, the bottom face 63 is rectangular (square), and an intersection point of the diagonal lines thereof is a center point of the bottom face. The wound body 10 is disposed so that the center axis c of the core member of the wound body is aligned and positioned at this center point. The wound body is placed on the white substrate (bottom face) 63 so that the cylindrical direction of the core member 1 is upright. Although dimensions of the light-shielding space are shown in FIG. 4, these dimensions are merely an example of the present embodiment, and the dimensions need not be the same as those in FIG. 4.

Figure 5:
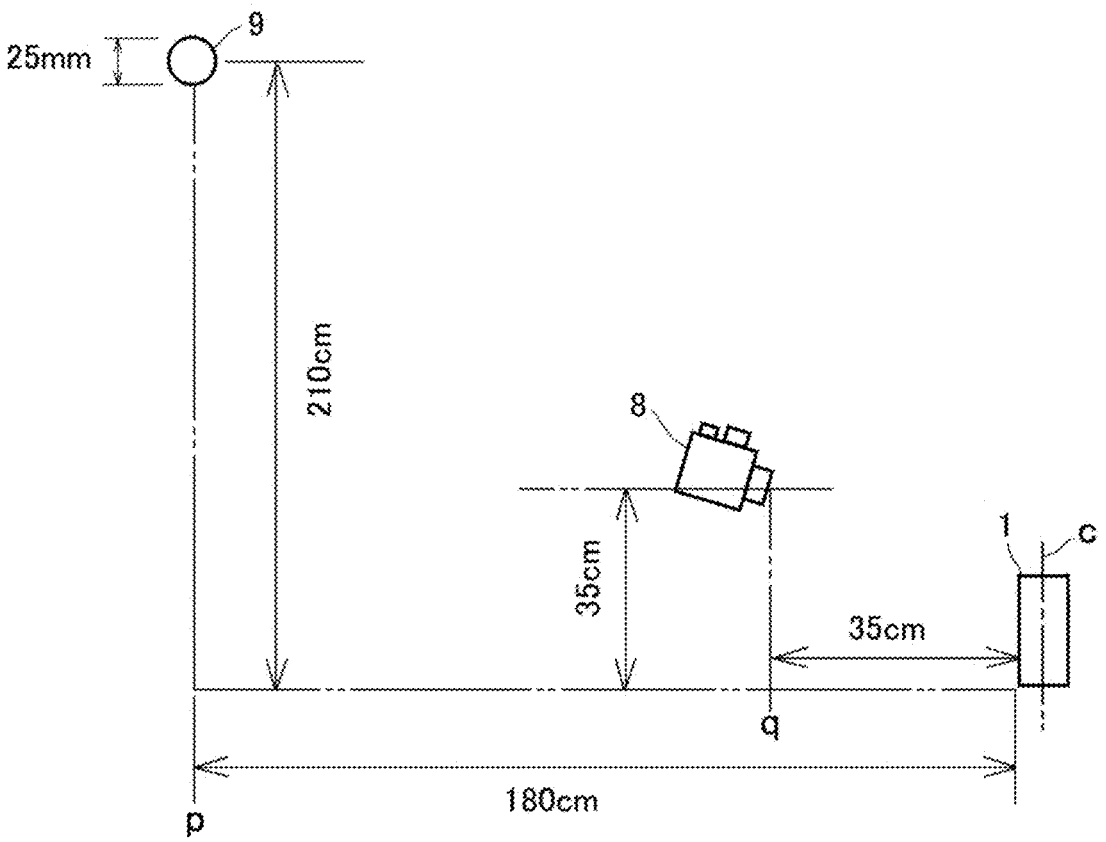
FIG. 5 is an explanatory diagram of test conditions schematically illustrating an aspect of testing in which a wound body is irradiated with light, and illustrates the test conditions in a state (a) viewed from the side and a state (b) viewed from above.
Figure 5:
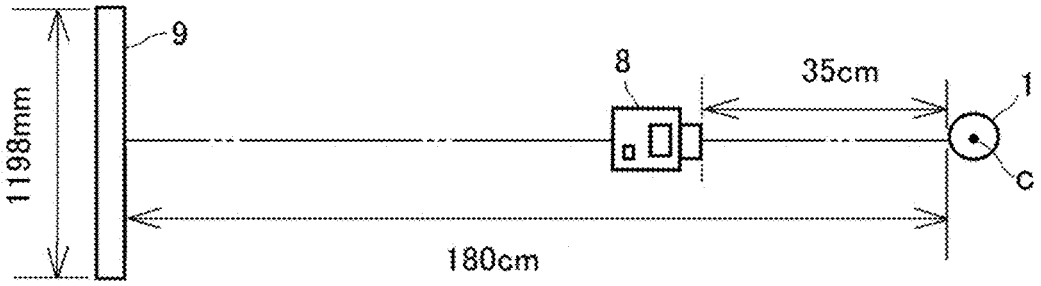

FIG. 5 is an explanatory diagram schematically illustrating an aspect of testing in which a wound body is irradiated with light, and illustrates the test conditions in a state (a) viewed from the side and a state (b) viewed from above. In FIG. 5, lighting 9 is disposed at a point that is located a distance of 210 cm in a direction perpendicular to the substrate face of the white substrate from a position p, the position p being separated from the center axis c of the core member 1 of the wound body by a distance of the radius of the core member plus 180 cm. From here, the light is irradiated toward the wound body so as to face a plane that includes the center axis of the wound body.

In FIG. 5, a photographing device (camera) is also disposed, along the direction of the lighting 9, at a point that is located a distance of 35 cm in a direction perpendicular to the substrate face of the white substrate from a position q, the position q being separated from the center axis c of the core member by a distance of the radius of the core member plus 35 cm. The photographing device (camera) 8 is not particularly limited, but a commercially available camera can be suitably used. The photographing mode may also be a commonly used mode, and may be an auto mode.

By irradiating light onto the wound body (the surface of the commingled yarn) of the present embodiment and capturing an image of the appearance thereof in this state, an image of a wound body on which two or more reflection lines appear as illustrated in FIG. 1 is obtained.

One example of the light that is irradiated is light with a luminous flux of 520 lm and a color temperature of 5000 K. If no reflection line is visible under these irradiation conditions, one wavelength from 420 nm to 700 nm, and one wavelength of luminous flux from 2750 lm to 5200 lm can be optionally stipulated. The color temperature is from 2000 to 5000 K.

<Dispersion Degree>

In the wound body of the present invention, the dispersion degree of the continuous reinforcing fibers in the continuous thermoplastic resin fibers is preferably at least 90%, more preferably at least 91%, even more preferably at least 92%, and yet even more preferably at least 93%. The upper limit may be 100%, or may be 99% or less. By setting the dispersion degree to a high level in this manner, fraying, sagging, and breakage can be effectively suppressed.

In the present invention, the dispersion degree is an indicator of whether the continuous reinforcing fibers and the continuous thermoplastic resin fibers are uniformly mixed, and as the value of the dispersion degree approaches 100%, the fibers are more uniformly mixed. The dispersion degree is measured in accordance with a method described in the examples below.

<Impregnation Rate>

Furthermore, in the present invention, the impregnation rate of the continuous thermoplastic resin fibers in the continuous reinforcing fibers is preferably 5% or less, more preferably 4% or less, even more preferably 3% or less, and yet even more preferably 2% or less. The lower limit may be 0%. By setting the impregnation rate to 5% or less, the suppleness of the commingled yarn is maintained, and the tendency of the commingled yarn to repel when made linear, or to become prone to disordering can be effectively suppressed. As a result, sagging can also be effectively suppressed.

The impregnation rate is defined as a ratio at which the continuous thermoplastic resin fibers are impregnated into the continuous reinforcing fibers, and is a value expressed based on a ratio of a surface area of a cross section perpendicular to the longitudinal direction of the impregnated continuous thermoplastic resin fibers with respect to a surface area of a cross section perpendicular to the longitudinal direction of the commingled yarn. The impregnation rate is measured in accordance with a method described in the examples below.

<Continuous Thermoplastic Resin Fibers>

The continuous thermoplastic resin fibers of the present invention may be formed from a thermoplastic resin composition. The thermoplastic resin composition may consist of only one type of thermoplastic resin, or may be formed from two or more types of thermoplastic resins, or may also include other components.

Examples of thermoplastic resins that can be used include polyolefin resins such as polyethylene and polypropylene, polyamide resins, polyester resins such as polyethylene terephthalate and polybutylene terephthalate, polycarbonate resins, polyoxymethylene resins (polyacetal resins), polyether ketone resins such as polyether ketone, polyether ether ketone, polyether ketone ketone, and polyether ether ketone ketone, polyether sulfone resins, polyether sulfide resins, polyphenylene sulfide resins, and thermoplastic polyimide resins such as thermoplastic polyether imides, thermoplastic polyamide imides, wholly aromatic polyimides and semi-aromatic polyimides. The thermoplastic resin is preferably at least one type selected from polyamide resins, polyether ketone resins, and polyphenylene sulfide resins, and is more preferably at least polyamide resins.

Examples of the polyamide resin used in the present invention include polyamide 4, polyamide 6, polyamide 11, polyamide 12, polyamide 46, polyamide 66, polyamide 610, polyamide 612, poly(hexamethylene terephthalamide) (polyamide 6T), poly(hexamethylene isophthalamide) (polyamide 6I), polyamide 66/6T, polyxylylene adipamide, polyxylylene sebacamide, polyxylylene dodecamide, polyamide 9T, polyamide 9MT, and polyamide 6I/6T.

Among the polyamide resins described above, a polyamide resin containing a constituent unit derived from a diamine and a constituent unit derived from a dicarboxylic acid, and for which 50 mol % or more of the constituent unit derived from a diamine is derived from xylylenediamine (hereinafter, also referred to as "XD-based polyamide"), is preferable from the perspectives of moldability and heat resistance.

Furthermore, in a case where the polyamide resin is a mixture, the proportion of the XD-based polyamide in the polyamide resin is preferably 50 mass % or more, more preferably 80 mass % or more, even more preferably 90 mass % or more, and particularly preferably 95 mass % or more.

In the XD-based polyamide, preferably 70 mol % or more, more preferably 80 mol % or more, even more preferably 90 mol % or more, and yet even more preferably 95 mol % or more, of the constituent unit derived from diamine is derived from xylylenediamine, and preferably 50 mol % or more, more preferably 70 mol % or more, even more preferably 80 mol % or more, yet even more preferably 90 mol % or more, and yet even more preferably 95 mol % or more, of the constituent unit derived from dicarboxylic acid is derived from α,ω-linear aliphatic dicarboxylic acid preferably having from 4 to 20 carbons.

The xylylenediamine preferably includes at least m-xylylenediamine, more preferably includes from 30 to 100 mol % of m-xylylenediamine and from 70 to 0 mol % of p-xylylenediamine, and even more preferably from 50 to 100 mol % of m-xylylenediamine and from 50 to 0 mol % of p-xylylenediamine.

Examples of the diamine that can be used as a raw material diamine component of the XD-based polyamide, other than m-xylylenediamine and p-xylylenediamine, include aliphatic diamines such as tetramethylenediamine, pentamethylenediamine, 2-methylpentanediamine, hexamethylenediamine, heptamethylenediamine, octamethylenediamine, nonamethylenediamine, decamethylenediamine, dodecamethylenediamine, 2,2,4-trimethylhexamethylenediamine, and 2,4,4-trimethylhexamethylenediamine; alicyclic diamines such as 1,3-bis(aminomethyl)cyclohexane, 1,4-bis(aminomethyl)cyclohexane, 1,3-diaminocyclohexane, 1,4-diaminocyclohexane, bis(4-aminocyclohexyl)methane, 2,2-bis(4-aminocyclohexyl)propane, bis(aminomethyl)decalin, and bis(aminomethyl)tricyclodecane; and diamines having aromatic ring(s), such as bis(4-aminophenyl)ether, p-phenylenediamine, and bis(aminomethyl)naphthalene. One type thereof can be used, or two or more types can be mixed and used.

In a case where a diamine other than xylylenediamine is used as the diamine component, the proportion thereof is less than 50 mol %, preferably 30 mol % or less, more preferably from 1 to 25 mol %, and particularly preferably from 5 to 20 mol %, of the constituent unit derived from a diamine.

Examples of the α,ω-linear aliphatic dicarboxylic acid having from 4 to 20 carbons that is preferably used as the raw material dicarboxylic acid component of the polyamide resin include aliphatic dicarboxylic acids, such as succinic acid, glutaric acid, pimelic acid, suberic acid, azelaic acid, adipic acid, sebacic acid, undecanedioic acid, and dodecanedioic acid. A single type thereof can be used, or two or more types thereof can be mixed and used. Among these, adipic acid or sebacic acid is preferable because the melting point of the polyamide resin is within an appropriate range for molding.

Examples of the dicarboxylic acid component other than the α,ω-linear aliphatic dicarboxylic acid having from 4 to 20 carbons include phthalic acid compounds, such as isophthalic acid, terephthalic acid, and orthophthalic acid; naphthalene dicarboxylic acid isomers, such as 1,2-naphthalene dicarboxylic acid, 1,3-naphthalene dicarboxylic acid, 1,4-naphthalene dicarboxylic acid, 1,5-naphthalene dicarboxylic acid, 1,6-naphthalene dicarboxylic acid, 1,7-naphthalene dicarboxylic acid, 1,8-naphthalene dicarboxylic acid, 2,3-naphthalene dicarboxylic acid, 2,6-naphthalene dicarboxylic acid, and 2,7-naphthalene dicarboxylic acid. One type thereof can be used, or two or more types thereof can be mixed and used.

In a case where a dicarboxylic acid other than the α,ω-linear aliphatic dicarboxylic acid having from 4 to 20 carbon atoms is used as the dicarboxylic acid component, use of terephthalic acid or isophthalic acid is preferable from the perspectives of molding processability and barrier properties. The proportions of the terephthalic acid and isophthalic acid are each preferably 30 mol % or less, more preferably from 1 to 30 mol %, and particularly preferably from 5 to 20 mol %, of the constituent unit derived from dicarboxylic acid.

Furthermore, besides the diamine component and the dicarboxylic acid component, lactams such as ε-caprolactam and laurolactam, and aliphatic aminocarboxylic acids such as aminocaproic acid and aminoundecanoic acid can also be used as copolymer components constituting the polyamide resin, within a range that does not impair the effect of the present invention.

One embodiment of the polyamide resin used in the present invention is an aspect in which 80 mol % or more of the constituent unit derived from a diamine is derived from meta-xylylenediamine, and 80 mol % or more of the constituent unit derived from a dicarboxylic acid is derived from adipic acid.

A second embodiment of the polyamide resin used in the present invention is an aspect in which of the constituent units derived from a diamine, from 10 to 90 mol % are derived from meta-xylylenediamine, and from 90 to 10 mol % are derived from para-xylylenediamine, and 80 mol % or more of the constituent unit derived from a dicarboxylic acid is derived from sebacic acid.

A number average molecular weight (Mn) of the polyamide resin used in the present invention is preferably from 6000 to 30000, more preferably from 8000 to 28000, even more preferably from 9000 to 26000, yet even more preferably from 10000 to 24000, and yet even more preferably from 11000 to 22000. When the number average molecular weight is in such a range, the heat resistance, modulus of elasticity, dimensional stability, and molding processability of the obtained molded article are further improved.

Note that the number average molecular weight (Mn) herein is calculated based on the terminal amino group concentration $[NH_2]$ (μeq/g) and the terminal carboxyl group concentration [COOH] (μeq/g) of the polyamide resin, using the following equation.

$$\text{Number average molecular weight } (Mn) = 2000000/([COOH]+[NH_2])$$

For the method of producing the polyamide resin, the description in the paragraphs [0052] and [0053] of JP 2014-173196 A, the contents of which are incorporated herein, can be taken into consideration.

The melting point of the polyamide resin is preferably from 150 to 310° C., more preferably from 180 to 300° C., and even more preferably from 180 to 250° C.

Furthermore, the glass transition temperature of the polyamide resin is preferably from 50 to 100° C., more preferably from 55 to 100° C., and particularly preferably from 60 to 100° C. The glass transition temperature in this range may improve the heat resistance of the obtained molded article.

The "glass transition temperature" refers to a glass transition temperature measured by heating and melting the sample once to eliminate the effect of the thermal history on the crystallinity, and then increasing the temperature once again. For the measurement, a differential scanning calorimeter (DSC) may be used to determine the melting point from the temperature at which the endothermic peak reaches its maximum. The endothermic peak is observed when approximately 1 mg of a sample is heated and melted from the room temperature to a temperature that is equal to or higher than an expected melting point at a temperature increase rate of 10° C./min while nitrogen is streamed at 30 mL/min as the atmosphere gas. Next, the melted polyamide resin is rapidly cooled by dry ice, and then the temperature is increased again to a temperature equal to or higher than the melting point at the rate of 10° C./min to determine the glass transition temperature and the melting point.

As the differential scanning calorimeter (DSC), for example, the "DSC-60" available from Shimadzu Corporation can be used.

The polyamide resin may be only one type or may be two or more types.

Furthermore, various types of components may be included in the thermoplastic resin composition used in the present invention, within a range that does not impair the object and effect of the present invention. For example, additives, such as elastomers, fillers besides the continuous reinforcing fibers, antioxidants, stabilizers such as a thermal stabilizer, hydrolysis-resistance improving agents, weather resistant stabilizers, matting agents, UV absorbers, nucleating agents, plasticizers, dispersants, flame retardants, antistatic agents, anti-coloration agents, anti-gelling agents, colorants, release agents, and lubricants may be added. For these details, refer to the description in paragraphs [0130] to [0155] of JP 4894982 B, the contents of which are incorporated in the present specification. Note that the thermoplastic resin composition used in the present invention may include the filler described above, but preferably does not include a filler described above. Specifically, the content of the filler in the thermoplastic resin composition is 3 mass % or less.

An example of a preferred embodiment of the thermoplastic resin used in the present invention is an aspect in which 80 mass % or more (preferably 90 mass % or more, and more preferably 95 mass % or more) of the thermoplastic resin is a polyamide resin.

The thermoplastic resin fibers used in the present invention are typically continuous fibers constituted from the abovementioned thermoplastic resin composition. Here, "continuous fibers" refer to fibers with a length greater than 50 mm, and fibers with a length greater than 1 m are practical. An average fiber length of the continuous thermoplastic resin fibers used in the present invention is not particularly limited; however, from the perspective of achieving excellent molding processability, the average fiber length is preferably in a range from 1 to 100000 m, more preferably in a range from 100 to 10000 m, and even more preferably in a range from 1000 to 5000 m.

A cross section of the continuous thermoplastic resin fibers in the present invention may be circular or oblate.

One type of continuous thermoplastic resin fibers may be used, or two or more types of continuous thermoplastic resin fibers may be used.

The continuous thermoplastic resin fibers used in the present invention are typically produced by using a continuous thermoplastic resin fiber bundle in which continuous thermoplastic resin fibers are bundled. A total fineness per one fiber of the continuous thermoplastic resin fiber bundle is preferably from 40 to 600 dtex, more preferably from 50 to 500 dtex, and even more preferably from 100 to 400 dtex. Even better dispersion of the continuous thermoplastic resin fibers within the resulting commingled yarn is achieved by including the continuous thermoplastic resin fibers with such fineness. The number of fibers constituting the continuous thermoplastic resin fiber bundle is preferably from 1 to 200 f, more preferably from 5 to 100 f, even more preferably from 10 to 80 f, and particularly preferably from 20 to 50 f. In particular, as described in detail below, in a case where commingled yarn is used to form the material of the present invention, dispersion of the continuous thermoplastic resin fibers may be improved.

The continuous thermoplastic resin fibers of the present invention are preferably continuous thermoplastic resin fibers having a treatment agent for continuous thermoplastic resin fibers on a surface thereof. For details thereof, the descriptions of paragraphs [0064] and [0065] of the pamphlet of WO 2016/159340, the contents of which are incorporated herein, can be referenced.

Breakage of the continuous thermoplastic resin fibers during the process of manufacturing the commingled yarn and in subsequent processing steps can be suppressed by configuring the continuous thermoplastic resin fibers to have a surface treatment agent.

The amount of the surface treatment agent of the continuous thermoplastic resin fibers is, for example, from 0.1 to 2.0 mass % of the thermoplastic resin fibers. The lower limit is preferably not less than 0.5 mass % and more preferably not less than 0.8 mass %. The upper limit value is preferably not greater than 1.8 mass % and more preferably not greater than 1.5 mass %. When the amount of the surface treatment agent is set to such a range, the dispersion of the continuous thermoplastic resin fibers is improved, and a more homogeneous commingled yarn is easily achieved. In addition, when a commingled yarn is being manufactured, frictional force with the machine and frictional force between fibers may be generated in the continuous thermoplastic resin fibers, and as a result, severing of the continuous thermoplastic resin fibers may occur at that time. However, when the amount of the surface treatment agent is set to the above-mentioned range, breakage of the fibers can be more effectively prevented. In addition, mechanical stress is applied to the continuous thermoplastic resin fibers in order to obtain a homogeneous commingled yarn, but severing of the continuous thermoplastic resin fibers by the stress at that time can also be more effectively prevented by setting the amount of the surface treatment agent to the abovementioned range.

The type of the surface treatment agent is not particularly defined as long as the surface treatment agent has a function of converging the continuous thermoplastic resin fibers or continuous reinforcing fibers. Preferable examples of the surface treatment agent include ester compounds, alkylene glycol compounds, polyolefin compounds, phenyl ether compounds, polyether compounds, silicone compounds, polyethylene glycol compounds, amide compound, sulfonate compounds, phosphate compounds, carboxylate compounds, and combinations of two or more thereof, and ester compounds are more preferable.

The treatment method by the surface treatment agent of the continuous thermoplastic resin fibers is not particularly limited as long as the intended purpose can be achieved. For example, the surface treatment agent is dissolved in a solution, which is then applied to the continuous thermoplastic resin fibers such that the treatment agent attaches to the continuous thermoplastic resin fibers. Alternatively, the treatment agent may be air blown onto the surface of the continuous thermoplastic resin fibers.

<Continuous Reinforcing Fibers>

Reinforcing fibers according to a preferred embodiment of the present invention are continuous fibers. Here, "continuous fibers" refer to fibers with a length greater than 50 mm, and fibers with a length greater than 1 m are practical. A cross section of the reinforcing fiber in the present invention may be circular or oblate. One type of reinforcing fibers may be used, or two or more types of reinforcing fibers may be used.

Examples of the reinforcing fibers used in the present invention include inorganic fibers, such as glass fibers, carbon fibers, alumina fibers, boron fibers, ceramic fibers, and metal fibers (steel fibers and the like); and organic fibers, such as plant fibers (kenaf, bamboo fibers, and the like), aramid fibers, polyoxymethylene fibers, aromatic polyamide fibers, polyparaphenylene benzobisoxazole fibers, and ultra high molecular weight polyethylene fibers. Among these, at least one type of carbon fibers, aramid fibers, or glass fibers is preferably included, at least one type of carbon fibers or glass fibers is more preferably included, and at least one type of carbon fibers is even more preferably included.

As the reinforcing fibers used in the present invention, reinforcing fibers treated with a treatment agent are preferably used. Examples of such treatment agents include sizing agents and surface treatment agents, and those described in paragraphs [0093] and [0094] of JP 4894982 B, the contents of which are incorporated in the present specification, are preferably used.

Examples of the surface treatment agent include those made from functional compounds such as epoxy compounds, acrylic compounds, isocyanate compounds, silane compounds, and titanate compounds, and for example, include silane coupling agents, titanate coupling agents, and the like, and silane coupling agents are preferable.

The sizing agent is preferably at least one type selected from epoxy resins, urethane resins, silane-based compounds, isocyanate compounds, titanate-based compounds, and polyamide resins, is more preferably at least one type selected from epoxy resins, urethane resins, silane coupling agents, water-insoluble polyamide resins, and water-soluble polyamide resins, is even more preferably at least one type selected from epoxy resins, urethane resins, water-insoluble polyamide resins, and water-soluble polyamide resins, and is yet even more preferably a water-soluble polyamide resin.

An amount of the treatment agent is preferably from 0.001 to 1.5 mass %, more preferably from 0.1 to 1.2 mass %, and even more preferably from 0.3 to 1.1 mass %, relative to the amount of the reinforcing fibers.

A known method can be used for the method of treating the reinforcing fibers with the treatment agent. For example, the reinforcing fibers are immersed in a solution in which the treatment agent is dissolved, and the treatment agent is deposited on the surface of the reinforcing fibers. Furthermore, the treatment agent can also be air-blown onto the surface of the reinforcing fibers. Furthermore, reinforcing fibers that have already been treated with the surface treatment agent or treatment agent may be used. Alternatively, surface treatment agents or treatment agents may be washed off from commercially available products, and then subjected to surface treatment again such that a desired amount of treatment agent may be deposited.

<Method for Manufacturing Commingled Yarn>

First, the thermoplastic resin composition is melt-extruded using an extruder into a strand form, and stretched while being wound with a roll, and a continuous thermoplastic resin fiber bundle wound into a wound body is obtained.

Respective fibers are drawn out from the obtained wound body of continuous thermoplastic resin fibers and from a wound body of continuous reinforcing fibers prepared in advance, and the fibers are opened by air blowing while passing through a plurality of guides. The continuous thermoplastic resin fibers and the continuous reinforcing fibers are bundled while being opened. At this time, it is preferable to apply air blowing while the fibers are passed through the plurality of guides, and to promote uniformity while the commingled yarn is prepared in a tape shape. At the time of this air blowing, the continuous reinforcing fibers and the continuous thermoplastic resin fibers may be surface treated using the treatment agent described above, or fibers of a fiber bundle that has been surface treated in advance may be drawn out from the wound body and used.

The commingled yarn according to a preferred embodiment of the present invention is preferably manufactured using a continuous thermoplastic resin fiber bundle and a continuous reinforcing fiber bundle. The total fineness of the fibers used in the manufacturing of a single commingled yarn (sum of the total fineness of the continuous thermoplastic resin fibers and the total fineness of the continuous reinforcing fibers used in the manufacturing of a single commingled yarn) is preferably from 1000 to 100000 dtex, more preferably from 1500 to 50000 dtex, even more preferably from 2000 to 50000 dtex, and particularly preferably from 3000 to 30000 dtex.

The total number of fibers used in the manufacturing of a single commingled yarn (number of fibers obtained by adding the total number of continuous thermoplastic resin fibers and the total number of continuous reinforcing fibers) is preferably from 100 to 100000 f, more preferably from 1000 to 100000 f, even more preferably from 1500 to 70000 f, and yet even more preferably from 2000 to 20000 f. When the total number of fibers is within such ranges, the commingled yarn exhibits an improved ability to commingle fibers, and a molded article better excelling in properties and texture can be obtained. Furthermore, the commingled yarn with the total number of fibers in such a range has a smaller region of biased concentration of either of the fibers, and both types of fibers are likely to be homogeneously dispersed.

The commingled yarn used in the present invention may be twisted. However, it is preferable that the fibers of the commingled yarn of the present invention are not twisted (meaning that the fibers in the commingled yarn are not actively twisted). In addition, twisting may occur at the end section of the wound body during winding, but this twisting is not actively applied. In addition, the twisting at the end section is a twisting that is eliminated during winding.

In the present invention, for example, an aspect in which the fiber materials of continuous thermoplastic resin fibers or continuous reinforcing fibers are opened to form a fiber bundle with the fibers arranged in parallel with each other is preferable.

<Commingled Yarn Applications>

In a slightly impregnated state, the commingled yarn according to a preferred embodiment of the present invention can be wound around a roll to form a wound body, or can be further processed into various molding materials. Examples of molding materials that use the commingled yarn include woven fabrics, braids, braided cords, nonwoven fabrics, random mats, and knitted materials. The commingled yarn of the present invention is moderately supple and exhibits little peeling of the fibers, and therefore is excellent in woven fabrics and knitted materials, and particularly in woven fabrics.

The form of the braided cords is not particularly limited, and examples thereof include a square cord, a flat cord, and a round cord.

The form of the woven fabric is not particularly limited, and may be a plain weave, an eight-harness satin weave, a four-harness satin weave, a twill weave, or the like. In addition, the woven fabric may be a so-called bias weave. Furthermore, as described in JP S55-30974 A, a so-called non-crimp woven fabric with substantially no bending may be used.

An example of a case of a woven fabric is an aspect in which the warp yarn and/or the weft yarn is a commingled yarn according to a preferred embodiment of the present invention. The other of the warp yarn and the weft yarn may be a commingled yarn according to the preferred embodiment of the present invention, but may be a reinforcing fiber or thermoplastic resin fiber according to the desired characteristics. In an example of an aspect in which thermoplastic resin fibers are used in the other of the warp yarn and the weft yarn, fibers containing, as a main component, a thermoplastic resin that is the same as the thermoplastic resin constituting the commingled yarn according to the preferred embodiment of the present invention are used.

The form of the knitted material is not particularly limited, and a known knitting method such as warp knitting, weft knitting, and raschel knitting can be freely selected.

The form of the nonwoven fabric is not particularly limited, and for example, commingled yarns according to a preferred embodiment of the present invention can be cut to form a fleece, and the commingled yarns can then be bonded together to form a nonwoven fabric. The fleece can be formed using a dry method, a wet method, or the like. Additionally, a chemical bond method, a thermal bond method, or the like can be used for bonding between the commingled yarns.

In addition, commingled yarns according to a preferred embodiment of the present invention can also be used by aligning the commingled yarns in one direction to form a tape-shaped or sheet-shaped base material, or as a braided cord or rope-shaped base material, or as a laminate obtained by laminating two or more of these base materials.

Furthermore, the commingled yarn according to a preferred embodiment of the present invention may also be preferably used as a composite material obtained by laminating and heating the commingled yarn, a braided cord, a woven fabric, a knitted material, a nonwoven fabric, or the like. The heating process can be performed, for example, at a temperature of 10 to 30° C. above the melting point of the thermoplastic resin.

A molded article obtained using a commingled yarn, molding material, or composite material according to a preferred embodiment of the present invention can be suitably used in electrical and electronic devices such as personal computers, OA equipment, AV equipment, and mobile phones; in components and housings for equipment such as optical equipment, precision equipment, toys, and home and office electrical products; and in components for automobiles, aircraft, ships, and the like. In particular, the present invention is suitable for manufacturing a molded article having a concave portion or a convex portion.

EXAMPLES

The present invention will be described in greater detail below through examples. The following materials, usage amounts, proportions, processing details, processing procedures, and the like described in the examples may be changed, as appropriate, as long as there is no deviation from the spirit of the present invention. Therefore, the scope of the present invention is not limited to the specific examples described below.

<Thermoplastic Resin>

MXD6: m-xylylene adipamide resin (grade S 6001, available from Mitsubishi Gas Chemical Company, Inc.); melting point: 237° C.; number average molecular weight: 16800

PA6: polyamide resin 6, 1022B, available from Ube Industries, Ltd.; melting point: 220° C.

MPXD10: xylylene sebacamide resin; melting point: 213° C.; number average molecular weight; 15400

<<MPXD10 Synthesis Example>>

In a reaction vessel equipped with a stirrer, a partial condenser, a total condenser, a thermometer, a dropping funnel, a nitrogen introduction tube, and a strand die, 10 kg (49.4 mol) of sebacic acid (TA grade, available from Itoh Oil Chemicals Co., Ltd.) and 11.66 g of sodium acetate/sodium hypophosphite monohydrate (molar ratio=1/1.5) were charged, and after sufficient purging of nitrogen was performed, heating and melting were performed to 170° C. under a small nitrogen stream while the system was agitated.

Under stirring, 6.647 kg of a mixed xylylenediamine in which the molar ratio of m-xylylenediamine (available from Mitsubishi Gas Chemical Company, Inc.) and p-xylylenediamine (available from Mitsubishi Gas Chemical Company, Inc.) was 70/30 (34.16 mol of m-xylylenediamine, 14.64 mol of p-xylylenediamine) was added dropwise to the molten sebacic acid while the condensed water generated was discharged out of the system, and the internal temperature was continuously increased to 240° C. over 2.5 hours.

After dropwise addition was completed, the internal temperature was increased, and when the temperature reached 250° C., the pressure inside the reaction vessel was reduced. The internal temperature was then further increased, and the melt polycondensation reaction was continued for 20 minutes at 255° C. Next, the inside of the system was pressurized with nitrogen, and the obtained polymer was removed from the strand die and pelletized to obtain a polyamide resin MPXD10.

The melting point of the obtained polyamide resin was 213° C., and the number average molecular weight was 15400.

<Continuous Reinforcing Fibers>

<<Continuous Carbon Fibers (CF)>>

Pyrofil-TR-50S-12000-AD, available from Mitsubishi Rayon Co., Ltd.; 8000 dtex; number of fibers: 12000 f; surface treated with an epoxy resin.

<<Continuous Glass Fibers (GF)>>

ECG 75 1/0 0.7Z, available from Nitto Boseki Co., Ltd.; fineness: 687 dtex; number of fibers: 400 f; surface treated with a sizing agent.

<Core Member>

Hollow core member made of paper with core member diameter of 3 inches and width of 280 mm, having embossed surface paper and being end surface treated, available from Showa Marutsutsu Co., Ltd.

Hollow core member made of paper with core member diameter of 6 inches and width of 280 mm, having embossed surface paper and being end surface treated, available from Showa Marutsutsu Co., Ltd.

Examples 1 to 10 and Comparative Examples 1 to 3

<Manufacturing of Continuous Thermoplastic Resin Fibers>

Each of the thermoplastic resins shown in Table 1 was melt-extruded using a single screw extruder having a 30 mm diameter screw, extruded into a strand form from a 60 hole-die, and stretched while being wound with a roll, and 800 m of a fiber bundle of continuous thermoplastic resin fibers was wound into a wound body. The melting temperature was set to a temperature that was 15° C. higher than the melting point of the continuous thermoplastic resin.

<Surface Treatment of the Thermoplastic Resin Fibers>

A deep vat was filled with an oil agent (polyoxyethylene hydrogenated castor oil (available from Kao Corporation, EMANON 1112)), a roller having a surface treated with rubber was installed such that a lower portion of the roller contacted the oil agent, and the roller was rotated so that the oil agent was constantly adhered to the roller surface. The oil agent was applied to the surface of the continuous thermoplastic resin fibers by contacting the continuous thermoplastic resin fibers with the roller.

<Manufacturing of Commingled Yarn>

The commingled yarn was manufactured according to the following method.

Respective fibers were drawn out from a wound body of continuous thermoplastic resin fibers having a length of 1 m or more, and from a wound body of continuous reinforcing fibers having a length of 1 m or more, and the fibers were opened by air blowing while passing through a plurality of guides. While the fibers were being opened, the continuous thermoplastic resin fibers and continuous reinforcing fibers were bundled, and further subjected to air blowing while the bundle was passed through a plurality of guides to make the bundle uniform.

Of the obtained commingled yarns, those that used carbon fibers had a fiber fineness of approximately 13000 dtex and a fiber count of approximately 13500 f, and those that used glass fibers had a fiber fineness of approximately 15000 dtex and a fiber count of approximately 10000 f; the volume ratio of the continuous thermoplastic resin fibers to the continuous reinforcing fibers was 1:1, and the proportion of the continuous reinforcing fibers was 61 mass % in the commingled yarns that used carbon fibers, and was 69 mass % in the commingled yarns that used glass fibers.

<Method for Measuring Dispersion Degree>

Figure 6:
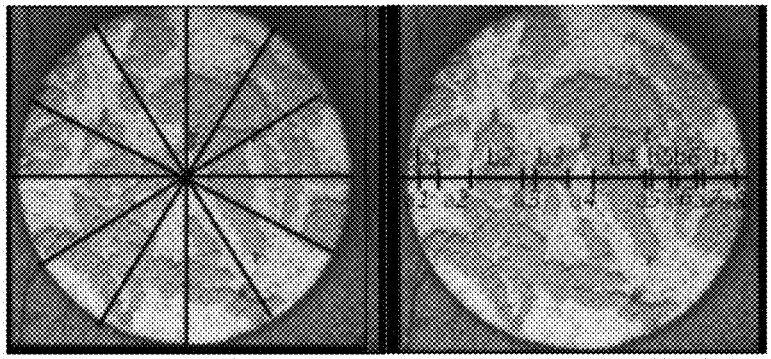
FIG. 6 is an image in which a cross-sectional view of the commingled yarn is observed with a microscope.

The commingled yarn was embedded in an epoxy resin, a cross-section perpendicular to the longitudinal direction of the commingled yarn was ground, and an image of a cross-sectional view was captured using an ultra-deep color 3D shape measuring microscope. As illustrated in FIG. 6, in the captured image, six equidistantly spaced auxiliary lines were drawn in a radial shape, and lengths of continuous reinforcing fiber regions on each of the auxiliary lines were measured as a1, a2, a3, . . . ai (i=n). In addition, the lengths of the continuous thermoplastic resin fiber regions on each auxiliary line were measured as b1, b2, b3, . . . bi (i=m). Based on the results, the dispersion degree was calculated using the following equation.

$$\left[1-\left(\frac{1}{n \text{ or } m}\times\frac{\sum_{i=1}^{n \text{ or } m}(a_i \text{ or } b_i)}{\sum_{i=1}^{n \text{ or } m}(a_i)+\sum_{i=1}^{n \text{ or } m}(b_i)}\right)\right]\times 100\ (\%) \quad \text{[Equation 3]}$$

As the ultra-deep color 3D shape measuring microscope, the VK-9500 (controller section)/VK-9510 (measurement section) (available from Keyence Corporation) was used.

<Method for Measuring Impregnation Rate>

The commingled yarn was embedded in an epoxy resin, a surface of a cross-section of the commingled yarns was ground, and an image of a cross-sectional view was captured using the ultra-deep color 3D shape measuring microscope. The cross-section of the fabricated molded article was observed with a digital microscope. In the obtained cross-sectional photograph, a region of the continuous reinforcing fibers impregnated with the thermoplastic resin was selected using the image analysis software ImageJ, and the surface area was measured. The impregnation rate was expressed as the (region of continuous reinforcing fibers impregnated with the thermoplastic resin)/(cross-sectional area) (unit: %).

As the ultra-deep color 3D shape measuring microscope, the VK-9500 (controller section)/VK-9510 (measurement section) (available from Keyence Corporation) was used.

Manufacturing of Wound Body (Examples 1 to 10, Comparative Examples 2 and 3)

The commingled yarn was passed through a fixed guide, and was wound while moving the core member horizontally in the long axis direction. The number of directions of traverse winding, the gap between traverses, the angle of traverse winding, and the movement distance were adjusted by the movement speed and movement direction of the core member tailored to each of the examples and comparative examples, and wound bodies were manufactured. The speed and angle when turning back of the commingled yarn at the core end were adjusted so that the commingled yarn was not twisted.

Manufacturing of Wound Body (Comparative Example 1)

A wound body was manufactured by a method similar to that of Example 1 with the exception that the core member was fixed and not moved in the long axis direction.

<Measurement of Fraying>

The commingled yarn was unwound 1 m in the winding direction, and fraying of the commingled yarn was visually confirmed.

A: None
B: Some
C: Yes

<Measurement of Disorder of the Lower Layer>

The wound body was placed so that the cylindrical direction of the core member stood upright, the commingled yarn of the upper layer was unwound, and the disorder of the lower layer was visually confirmed.

A: None
B: Some
C: Yes

<Measurement of Sagging>

The wound body was placed so that the cylindrical direction of the core member stood upright, and sagging of the commingled yarn at an angle larger than the angle of the traverse winding was visually confirmed.

A: None
B: Some
C: Yes

<Breakage Measurement>

The commingled yarn was unwound 1 m in the winding direction, and breakage was visually confirmed.

A: No breakage in fibers constituting the commingled yarn

B: Some breakage in fibers constituting the commingled yarn

C: Breakage in a significant number of fibers constituting the commingled yarn when irradiated with light under the conditions indicated in the <Irradiation Conditions> section above.

Figure 7:
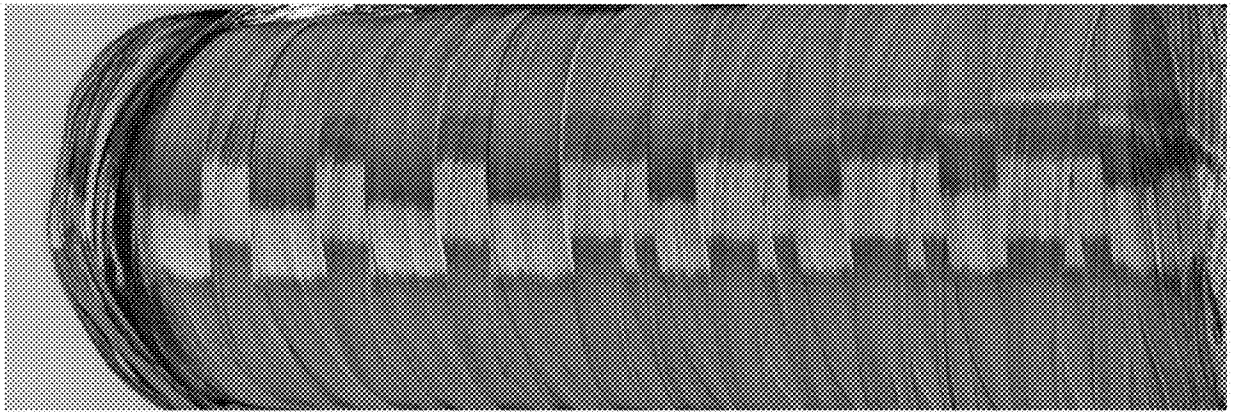
FIG. 7 is an image illustrating the outward appearance of a wound body according to an embodiment of the present invention.

The state of the reflection lines when the wound body of Example 1 was irradiated with light is illustrated in FIG. 7. The following were used as the lighting for light irradiation and the camera.

Lighting: Natural color FHF32EX-N-H 1198 mm, 25 mm tube, available from Panasonic Corporation

TABLE 1

| | Example 1 | Example 2 | Example 3 | Example 4 | Example 5 | Example 6 | Example 7 |
|---|---|---|---|---|---|---|---|
| Resin type | MXD6 | MXD6 | MXD6 | PA6 | MXD6 | MXD6 | MXD6 |
| Type of reinforcing fibers | CF | CF | CF | CF | GF | CF | CF |
| Width (mm) of commingled yarn | 10 | 10 | 10 | 10 | 15 | 10 | 10 |
| Dispersion degree | 95% | 95% | 95% | 95% | 95% | 95% | 95% |
| Impregnation rate | 1% or less | 1% or less | 1% or less | 1% or less | 1% or less | 1% or less | 1% or less |
| Number of traverse winding directions | 2 | 3 | 4 | 2 | 2 | 2 | 2 |
| Gap (mm) between commingled yarns | 17 | 17, 29 | 17.45 | 17 | 14 | 37 | 93 |
| Traverse winding angle (°) | ±5 | ±5, +8 | ±5, ±10 | ±5 | ±5 | ±5 | ±20 |
| Core member diameter | 3 inches | 3 inches | 3 inches | 3 inches | 3 inches | 6 inches | 3 inches |
| Movement distance (mm) | 27 | 27, 39 | 27, 55 | 27 | 27 | 47 | 103 |
| Winding width (cm) of commingled yarn | 25 | 25 | 30 | 25 | 25 | 20 | 25 |
| (Winding width)/(commingled yarn width) | 25 | 25 | 30 | 25 | 17 | 20 | 25 |
| Length of commingled yarn to be wound | Appro-priate | Appro-priate | Appro-priate | Appro-priate | Appro-priate | Appro-priate | Appro-priate |
| Linear reflection lines | 2 | 3 | 4 | 2 | 2 | 2 | 2 |
| Fraying | A | A | A | A | A | A | B |
| Lower layer disorder | A | A | A | A | A | A | A |
| Sagging | A | A | A | A | A | B | A |
| Breakage | A | A | A | A | A | A | A |

TABLE 2

| | Example 8 | Example 9 | Example 10 | Comparative Example 1 | Comparative Example 2 | Comparative Example 3 |
|---|---|---|---|---|---|---|
| Resin type | MXD6 | MXD6 | MPXD10 | MXD6 | MXD6 | MXD6 |
| Type of reinforcing fibers | CF | CF | CF | CF | CF | CF |
| Width (mm) of commingled yarn | 10 | 10 | 10 | 10 | 10 | 10 |
| Dispersion degree | 95% | 95% | 95% | 95% | 95% | 95% |
| Impregnation rate | 1% or less | 1% or less | 1% or less | 1% or less | 1% or less | 20% |
| Number of traverse winding directions | 2 | 2 | 2 | — | 2 | 2 |
| Gap (mm) between commingled yarns | 17 | 17 | 17 | — | 0 | 17 |
| Traverse winding angle (°) | ±5 | ±5 | ±5 | — | ±1 | ±5 |
| Core member diameter | 3 inches | 3 inches | 3 inches | 3 inches | 3 inches | 3 inches |
| Movement distance (mm) | 27 | 27 | 27 | — | 5 | 27 |
| Winding width (cm) of commingled yarn | 25 | 25 | 25 | — | 25 | 25 |
| (Winding width)/(commingled yarn width) | 25 | 25 | 25 | — | 25 | 25 |
| Length of commingled yarn to be wound | Short | Appro-priate | Appro-priate | Appro-priate | Appro-priate | Appro-priate |
| Linear reflection lines | 2 | 2 | 2 | 0 | 0 | 0 |
| Fraying | B | A | A | C | C | C |
| Lower layer disorder | B | B | A | C | C | C |
| Sagging | B | A | A | C | A | C |
| Breakage | A | A | A | B | A | C |

In Tables 1 and 2 above, the "type of resin" indicates the type of resin of the continuous thermoplastic resin fibers, and the "type of reinforcing fibers" indicates the type of continuous reinforcing fibers.

The "movement distance" refers to the movement distance with regard to central portion in the center axis direction of the core member when the commingled yarn is traversely wound one turn around the core member.

The "(winding width)/(commingled yarn width)" is a value obtained by dividing the winding width of the commingled yarn by the width of the commingled yarn.

The "linear reflection lines" indicates the number of reflection lines appearing on the surface of the wound body Camera: Tough Stylus TG-3 CmIII Automode, available from Olympus Corporation In the wound bodies of the examples, the direction of traverse winding ranged from two to four directions, and as is clear from the above results, it was confirmed that linear reflection lines corresponding to the number of winding directions appeared on the surface of the wound bodies when irradiated with light. It is also clear that in the wound bodies of these examples, fraying, disorder of the lower layer, sagging, and breakage were suppressed. Regarding these items, when the ratio of the (winding width)/(commingled yarn width) and the length of the commingled yarn to be wound were appropriate, and the diameter of the core member was 3 inches (76.2 mm), a particularly high effect was obtained when the angle of traverse winding was ±10° or less. In particular, in Examples 2 and 3, a layer (commingled yarn) of a different angle was present between two layers wound at ±5° as in Example 1, and winding that is less prone to entanglement was achieved.

On the other hand, the wound bodies of Comparative Examples 1, 2 and 3 in which no reflection lines were observed experienced frayed, and disorder of the lower layer was observed. Furthermore, sagging was also observed in Comparative Example 1. In addition, sagging and breakage were observed in Comparative Example 3.

Meanwhile, in Example 1, when the impregnation rate was set to 20%, a significant proportion of the resin was melted, the tape was hard, and a commingled yarn was not formed.

REFERENCE SIGNS LIST

1 Core member
2 Commingled yarn (tape)
8 Photographing device (camera)
9 Lighting
Wound body
21 Continuous thermoplastic resin fibers (continuous fibers of polyamide resin)
22 Continuous reinforcing fibers (continuous carbon fibers)
60 Light-shielded space
61, 64 Test bench (side surface plate) (white substrate) for reflection test
62 Test bench (back face plate) (blue substrate) for reflection test
63 Test bench (bottom face plate) (white substrate) for reflection test
71, 72 Reflection line
c Center axis of core member
v Linear direction orthogonal to center axis
θ1, θ2, θ3 Traverse winding angle
d1, d2, d3 Traverse winding direction
w1, w2, w3 Gap between commingled yarns
w11 Width of commingled yarn
wt Movement distance with regard to a central portion in the center axis c direction of the core member when the commingled yarn is traversely wound one turn around the core member
t Thickness of commingled yarn
wa, wb, wc Traverse winding width (winding width)

The invention claimed is:

1. A wound body comprising a core member and a commingled yarn traversely wound onto the core member; wherein the commingled yarn is traversely wound such that a gap is present between the commingled yarn and a closest commingled yarn traversely wound in the same direction;

the commingled yarn is constituted from continuous reinforcing fibers and continuous thermoplastic resin fibers;

a dispersion degree of the continuous reinforcing fibers in the continuous thermoplastic resin fibers is 90% or more;

an impregnation rate of the continuous thermoplastic resin fibers in the continuous reinforcing fibers is 5% or less;

the commingled yarn is traversely wound in two to four directions;

the commingled yarn is traversely wound in at least a direction from 3 to 25° and a direction from −3 to −25°, with respect to a straight line orthogonal to a center axis of the core member;

a ratio of a moved distance/width of commingled yarn, which is a ratio of a distance at which the commingled yarn is moved with regard to a central portion in the center axis direction of the core member when the commingled yarn has been traversely wound one turn around the core member, to a width of the commingled yarn, is from 2.0 to 12.0;

the commingled yarn is non-twisted and in a tape shape with a width from 7 to 20 mm;

a ratio of a width of traverse winding/width of commingled yarn, which is a ratio of a width at which the commingled yarn is wound onto the core member to a width of the commingled yarn, is from 15 to 40; and a diameter of the core member is from 5 to 20 cm;

where the dispersion degree is defined as a value that is obtained by embedding the commingled yarn in an epoxy resin, grinding a cross section perpendicular to a longitudinal direction of the embedded commingled yarn, photographing a cross-sectional view using an ultra-deep color 3D shape measuring microscope, drawing six equidistantly spaced auxiliary lines in a radial shape in the captured image, measuring lengths of continuous reinforcing fiber regions on each of the auxiliary lines as a1, a2, a3, . . . ai (i=n), measuring lengths of continuous thermoplastic resin fiber regions on each of auxiliary lines as b1, b2, b3, . . . bi (i=m), and then calculating the dispersion degree from the following equation:

$$\left[1-\left(\frac{1}{n \text{ or } m}\times\frac{\sum_{i=1}^{n \text{ or } m}(a_i \text{ or } b_i)}{\sum_{i=1}^{n \text{ or } m}(a_i)+\sum_{i=1}^{n \text{ or } m}(b_i)}\right)\right]\times 100\ (\%);$$

and the impregnation rate is defined as a ratio at which the continuous thermoplastic resin fibers are impregnated into the continuous reinforcing fibers, and is a value expressed based on a ratio of a surface area of a cross section perpendicular to the longitudinal direction of the impregnated continuous thermoplastic resin fibers with respect to a surface area of a cross section perpendicular to the longitudinal direction of the commingled yarn.

2. The wound body according to claim 1, wherein the continuous thermoplastic resin fibers include at least one of polyamide resins, polyether ketone resins, and polyphenylene sulfide resins.

3. The wound body according to claim 1, wherein the continuous thermoplastic resin fibers comprise a polyamide resin constituted from a constituent unit derived from a diamine and a constituent unit derived from a dicarboxylic acid, with 50 mol % or more of the constituent units derived from a diamine being derived from xylylene diamine.

4. The wound body according to claim 1, wherein the continuous reinforcing fibers include at least one of carbon fibers and glass fibers.

5. The wound body according to claim 1, wherein the commingled yarn is traversely wound in at least a direction from 3 to 35° and a direction from −3 to −35°, with respect to a straight line orthogonal to the center axis of the core member.

6. The wound body according to claim 1, wherein when the commingled yarn has been traversely wound one turn around the core member, the commingled yarn is moved 14 to 45 mm with regard to a central portion in the center axis direction of the core member.

7. The wound body according to claim 1, wherein a diameter of the core member is from 5 to 20 cm.

8. A method for manufacturing a wound body described in claim 1, the method comprising traversely winding the commingled yarn onto the core member in at least two directions from 3 to 25° and −3 to −25°, with respect to a straight line orthogonal to the core member, and traversely winding such that a gap is present between the commingled yarn and a closest commingled yarn traversely wound in the same direction.

* * * * *